US006209345B1

(12) United States Patent
Morton et al.

(10) Patent No.: US 6,209,345 B1
(45) Date of Patent: Apr. 3, 2001

(54) ICE CREAM CADDY SYSTEM

(76) Inventors: Carroll Morton, 5235 Freese La., Las Cruces, NM (US) 88005; Jason L. Garrett, 1805 S. 17th St., Artesia, NM (US) 88210

( * ) Notice: Subject to any disclaimer, the term of this patent is extended or adjusted under 35 U.S.C. 154(b) by 0 days.

(21) Appl. No.: 09/561,684

(22) Filed: May 1, 2000

(51) Int. Cl.[7] ..... F25D 3/08
(52) U.S. Cl. ..... 62/457.4; 411/913
(58) Field of Search ..... 62/457.2, 457.3, 62/457.4, 457.5, 457.9, 371, 340; 220/737, 339, 592.14, 592.24; 403/408.1; 411/508, 509, 510, 913, 338, 339

(56) References Cited

U.S. PATENT DOCUMENTS

| | | | | |
|---|---|---|---|---|
| 962,527 | * | 6/1910 | Reynolds | 220/592.14 |
| 4,498,312 | | 2/1985 | Schlosser | 62/457 |
| 4,537,044 | | 8/1985 | Putnam | 62/371 |
| 5,297,616 | | 3/1994 | Pralus | 165/47 |
| 5,568,735 | | 10/1996 | Newkirk et al. | 62/457.7 |
| 5,570,588 | | 11/1996 | Lowe | 62/457.7 |
| 5,598,943 | | 2/1997 | Markus | 220/410 |
| 5,740,951 | * | 4/1998 | Jack | 62/457.4 |
| 5,850,676 | * | 12/1998 | Takahashi et al. | 411/508 |

* cited by examiner

*Primary Examiner*—Corrine McDermott
*Assistant Examiner*—Mohammad M. Ali
(74) *Attorney, Agent, or Firm*—Joseph N. Breaux

(57) ABSTRACT

A system for transporting ice cream to locations where freezer facilities are unavailable. The ice cream caddy system includes an insulated holder for containing a quantity of ice cream surrounded by a supply of ice and rock salt. The ice cream caddy system also includes holding facilities for holding and transporting a number of serving bowls and spoons as well as an ice cream scoop.

1 Claim, 2 Drawing Sheets

ICE CREAM CADDY SYSTEM

TECHNICAL FIELD

The present invention relates to portable food preserving caddies and devices and more particularly to an ice cream caddy system for storing and transporting ice cream and ice cream eating utensils and the like that includes an insulated lid member, an open topped, cylinder shaped, outer insulated cooling mixture container member, and an inner, open topped cylinder shaped ice cream container member; the open topped, cylinder shaped, outer insulated cooling mixture container member being sized to receive the insulated lid member thereon in a manner to seal a top opening of the cooling mixture container member; the inner, open topped cylinder shaped ice cream container member defining an ice cream receiving cavity accessible through an open top and being centered within and permanently secured to a bottom surface of the cooling mixture container member to form a tube shaped cooling mixture cavity defined between an interior wall of the cooling mixture container member and an outer wall of the ice cream container member for receiving a cooling mixture including ice and rock salt; the ice cream container member having a number of elongated cooling mixture passage slots formed therethrough providing fluid communication between the ice cream receiving cavity and the tube shaped cooling mixture cavity; the cooling mixture container member having two spaced handle attachment structures on an exterior surface thereof between which a handle assembly is secured; each of the handle attachment structures being attached to the cooling mixture container member with a retainer pin/snap ring assembly including a washer insert, a retaining pin having locking structures extending outwardly from an end thereof and a locking ring sized to snap fit over the locking structures of the retaining pin.

BACKGROUND ART

Many individuals enjoy ice cream even in remote locations where ice cream storage facilities are unavailable. It would be a benefit to these individuals to have an ice cream caddy system that provided an insulated holder that could contain a supply of ice and rock salt to allow a quantity of ice cream to be transported to a remote location for consumption and held for a period of time without melting. It would of course also be a benefit if the ice cream caddy system included a holding device for holding and transporting a number of serving bowls and spoons as well as an ice cream scoop.

GENERAL SUMMARY DISCUSSION OF INVENTION

It is thus an object of the invention to provide an ice cream caddy system for storing and transporting ice cream and ice cream eating utensils and the like that includes an insulated lid member, an open topped, cylinder shaped, outer insulated cooling mixture container member, and an inner, open topped cylinder shaped ice cream container member; the open topped, cylinder shaped, outer insulated cooling mixture container member being sized to receive the insulated lid member thereon in a manner to seal a top opening of the cooling mixture container member; the inner, open topped cylinder shaped ice cream container member defining an ice cream receiving cavity accessible through an open top and being centered within and permanently secured to a bottom surface of the cooling mixture container member to form a tube shaped cooling mixture cavity defined between an interior wall of the cooling mixture container member and an outer wall of the ice cream container member for receiving a cooling mixture including ice and rock salt; the ice cream container member having a number of elongated cooling mixture passage slots formed therethrough providing fluid communication between the ice cream receiving cavity and the tube shaped cooling mixture cavity; the cooling mixture container member having two spaced handle attachment structures on an exterior surface thereof between which a handle assembly is secured; each of the handle attachment structures being attached to the cooling mixture container member with a retainer pin/snap ring assembly including a washer insert, a retaining pin having locking structures extending outwardly from an end thereof and a locking ring sized to snap fit over the locking structures of the retaining pin.

Accordingly, an ice cream caddy system is provided. The ice cream caddy system includes an insulated lid member, an open topped, cylinder shaped, outer insulated cooling mixture container member, and an inner, open topped cylinder shaped ice cream container member; the open topped, cylinder shaped, outer insulated cooling mixture container member being sized to receive the insulated lid member thereon in a manner to seal a top opening of the cooling mixture container member; the inner, open topped cylinder shaped ice cream container member defining an ice cream receiving cavity accessible through an open top and being centered within and permanently secured to a bottom surface of the cooling mixture container member to form a tube shaped cooling mixture cavity defined between an interior wall of the cooling mixture container member and an outer wall of the ice cream container member for receiving a cooling mixture including ice and rock salt; the ice cream container member having a number of elongated cooling mixture passage slots formed therethrough providing fluid communication between the ice cream receiving cavity and the tube shaped cooling mixture cavity; the cooling mixture container member having two spaced handle attachment structures on an exterior surface thereof between which a handle assembly is secured; each of the handle attachment structures being attached to the cooling mixture container member with a retainer pin/snap ring assembly including a washer insert, a retaining pin having locking structures extending outwardly from an end thereof and a locking ring sized to snap fit over the locking structures of the retaining pin.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
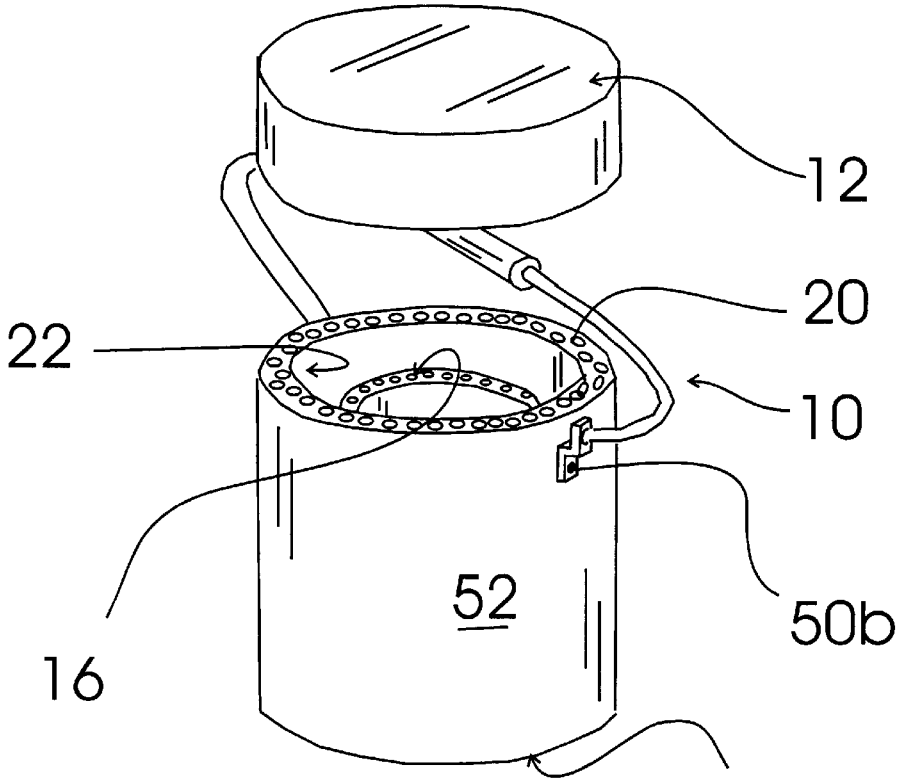
FIG. 1 is a perspective view of an exemplary embodiment of the ice cream caddy system of the present invention showing the insulated lid member; the open topped, cylinder shaped, outer insulated cooling mixture container member sized to receive the insulated lid member thereon in a manner to seal a top opening thereof; and the inner, open topped cylinder shaped ice cream container member defining an ice cream receiving cavity and being centered within and permanently secured to a bottom surface of the cooling mixture container member to form a tube shaped cooling mixture cavity defined between an interior wall of the cooling mixture container member and an outer wall of the ice cream container member; the ice cream container member having a number of elongated cooling mixture passage slots formed therethrough providing fluid communication between the ice cream receiving cavity and the tube shaped cooling mixture cavity; the cooling mixture container member having two spaced handle attachment structures on an exterior surface thereof between which a handle assembly is secured; each of the handle attachment structures being attached to the cooling mixture container member with a retainer pin/snap ring assembly including a washer insert, a retaining pin having locking structures extending outwardly from an end thereof and a locking ring sized to snap fit over the locking structures of the retaining pin.

FIG. 1 shows an exemplary embodiment of the ice cream caddy system of the present invention generally designated 10. Ice cream caddy system 10 includes an insulated lid member, generally designated 12; an open topped, cylinder shaped, outer insulated cooling mixture container member, generally designated 14; and an inner, open topped cylinder shaped ice cream container member, generally designated 16. Open topped, cylinder shaped, outer insulated cooling mixture container member 14 is sized to receive insulated lid member 12 on a rim portion 20 thereof in a manner to seal a top opening 22 of cooling mixture container member 14.

Figure 2:
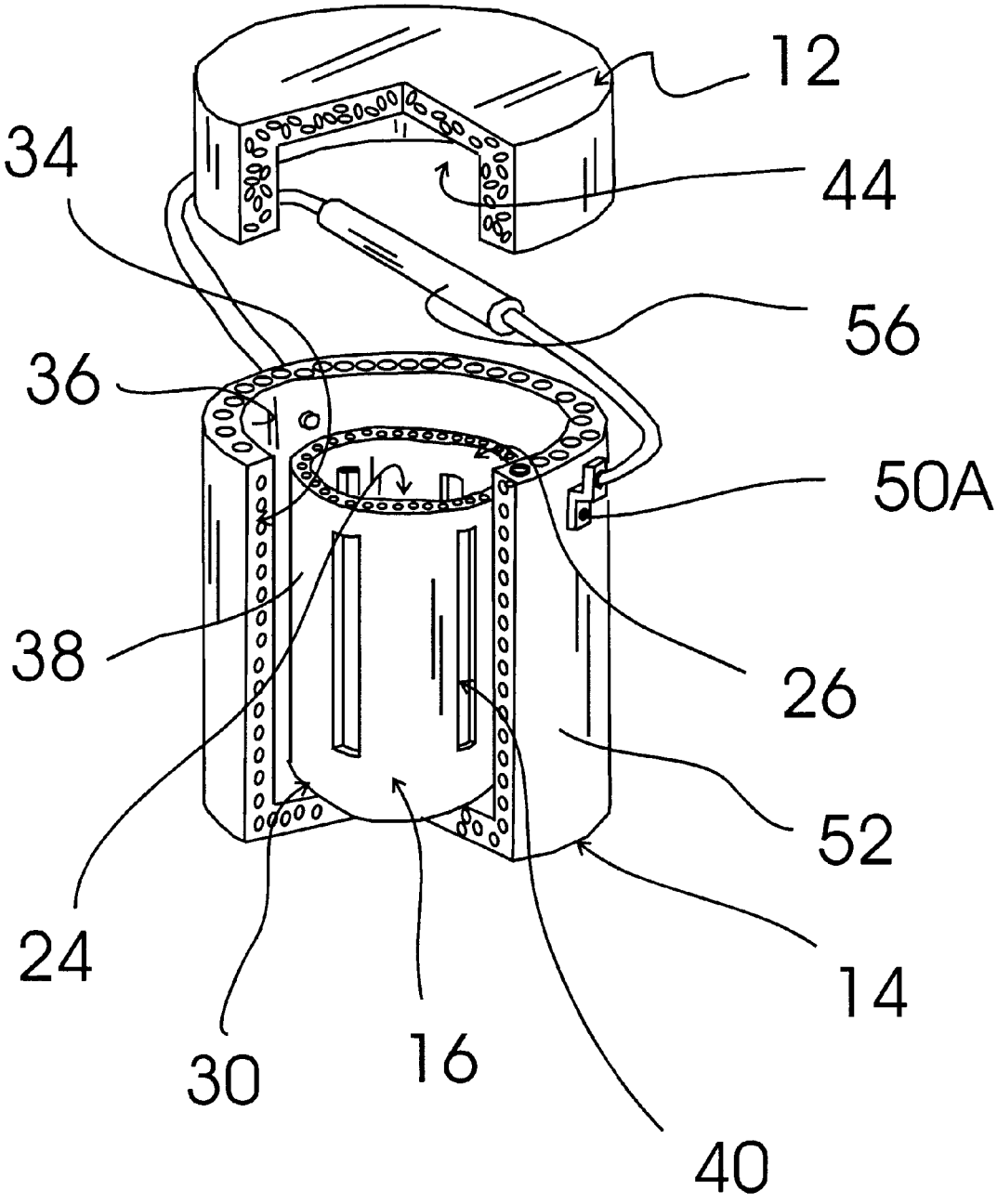
FIG. 2 is a partial cut-away, perspective view of the exemplary ice cream caddy system of FIG. 1 showing the foam construction of the insulated lid member, the cooling mixture container member and the ice cream container member; the tube shaped cooling mixture cavity defined between an interior wall of the cooling mixture container member and an outer wall of the ice cream container member provided for receiving a mixture of ice and rock salt; the elongated cooling mixture passage slots formed through the ice cream container member providing fluid communication between the ice cream receiving cavity and the tube shaped cooling mixture cavity; the cooling mixture container member and the lid member being sized to house a number of ice cream serving bowls if desired; the ice cream receiving cavity being sized to receive a number of spoons and an ice cream scoop as well as a carton of ice cream.

With reference to FIG. 2, ice cream container member 16 defines an ice cream receiving cavity 24 accessible through a round open top 26 and is centered within and permanently secured to a bottom surface 30 of cooling mixture container member 14 to form a tube shaped cooling mixture cavity 34 defined between an interior wall 36 of cooling mixture container member 14 and an outer wall 38 of ice cream container member 16 for receiving a cooling mixture including ice and rock salt. Ice cream container member 16 has four elongated cooling mixture passage slots 40 formed therethrough providing fluid communication between ice cream receiving cavity 24 and tube shaped cooling mixture cavity 34. In this embodiment, ice cream receiving cavity is sized to receive and hold a gallon container of ice cream as well as a number of spoons and an ice cream scoop. Lid member 12 is provided with a bowl storage cavity 44 for providing a storage area for a number of serving bowls when lid 12 is placed onto cooling mixture container 14.

Figure 3:
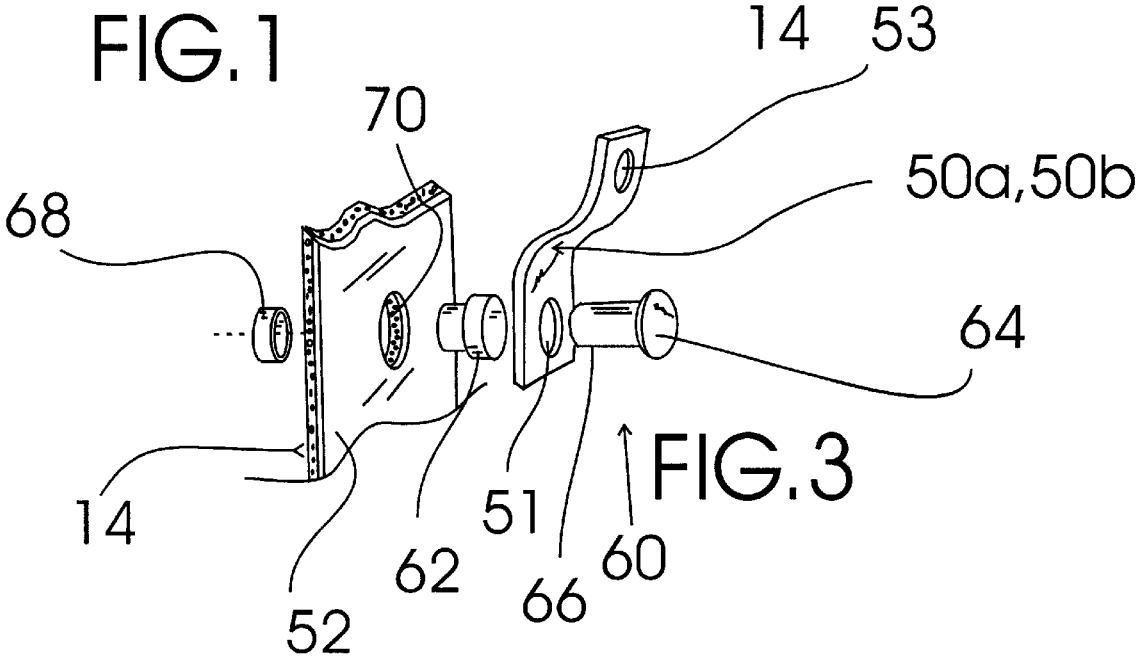
FIG. 3 is an exploded perspective view showing a section of the cooling mixture container member with an aperture provided therethrough, a dog-leg bent handle attachment structure having a member attachment aperture formed through one portion and a handle attachment aperture formed through the remaining portion, and a retainer pin/snap ring assembly including a washer insert, a retaining pin having locking structures extending outwardly from an end thereof and a locking ring sized to snap fit over the locking structures of the retaining pin.

Cooling mixture container member 14 has two identical, spaced handle attachment structures 50*a*,50*b* on an exterior surface 52 thereof between which a handle assembly 56 is secured. With reference to FIG. 3, each of the handle attachment structures 50*a*,50*b* is a dog-leg shape bent structure having a member attachment aperture 51 formed through one portion and a handle attachment aperture 53 formed through the remaining portion and is attached to the outer surface 52 of cooling mixture container member 14 with a retainer pin/snap ring assembly, generally designated 60 including a washer insert 62, a retaining pin 64 having locking structures 66 extending outwardly from an end thereof and a locking ring 68 sized to snap fit over locking structures 66 of retaining pin 64. During installation, a section of the cooling mixture container member 14 is provided with an aperture 70 into which washer insert 62 is inserted. Member attachment aperture 51 of handle attachment structure 50*a*,50*b* is then aligned with washer insert 62 and the end of retainer pin 64 inserted through and into the interior of cooling mixture container member 14 where locking ring 68 is then snap fit over locking structures 66 of retaining pin 64.

It can be seen from the preceding description that an ice cream caddy system for storing and transporting ice cream and ice cream eating utensils and the like has been provided that includes an insulated lid member, an open topped, cylinder shaped, outer insulated cooling mixture container member, and an inner, open topped cylinder shaped ice cream container member; the open topped, cylinder shaped, outer insulated cooling mixture container member being sized to receive the insulated lid member thereon in a manner to seal a top opening of the cooling mixture container member; the inner, open topped cylinder shaped ice cream container member defining an ice cream receiving cavity accessible through an open top and being centered within and permanently secured to a bottom surface of the cooling mixture container member to form a tube shaped cooling mixture cavity defined between an interior wall of the cooling mixture container member and an outer wall of the ice cream container member for receiving a cooling mixture including ice and rock salt; the ice cream container member having a number of elongated cooling mixture passage slots formed therethrough providing fluid communication between the ice cream receiving cavity and the tube shaped cooling mixture cavity; the cooling mixture container member having two spaced handle attachment structures on an exterior surface thereof between which a handle assembly is secured; each of the handle attachment structures being attached to the cooling mixture container member with a retainer pin/snap ring assembly including a washer insert, a retaining pin having locking structures extending outwardly from an end thereof and a locking ring sized to snap fit over the locking structures of the retaining pin.

It is noted that the embodiment of the ice cream caddy system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An ice cream caddy system comprising:

an insulated lid member;

an open topped, cylinder shaped, outer insulated cooling mixture container member; and an inner, open topped cylinder shaped ice cream container member;

said open topped, cylinder shaped, outer insulated cooling mixture container member being sized to receive said insulated lid member thereon in a manner to seal a top opening of said cooling mixture container member;

said inner, open topped cylinder shaped ice cream container member defining an ice cream receiving cavity accessible through an open top and being centered within and permanently secured to a bottom surface of said cooling mixture container member to form a tube shaped cooling mixture cavity defined between an interior wall of said cooling mixture container member and an outer wall of said ice cream container member for receiving a cooling mixture including ice and rock salt;

said ice cream container member having a number of elongated cooling mixture passage slots formed therethrough providing fluid communication between said ice cream receiving cavity and said tube shaped cooling mixture cavity;

said cooling mixture container member having two spaced handle attachment structures on an exterior surface thereof between which a handle assembly is secured;

each of said handle attachment structures being attached to said cooling mixture container member with a retainer pin/snap ring assembly including a washer insert, a retaining pin having locking structures extending outwardly from an end thereof and a locking ring sized to snap fit over said locking structures of said retaining pin.

* * * * *